US006089215A

United States Patent [19]

Morris et al.

[11] Patent Number: 6,089,215

[45] Date of Patent: Jul. 18, 2000

[54] BALL THROWING APPARATUS

[76] Inventors: Delmas Morris, Rte. 2, Box 825; Gary Milner, P.O. Box 521, both of Valliant, Okla. 74764

[21] Appl. No.: 09/379,170

[22] Filed: Aug. 23, 1999

[51] Int. Cl.[7] ..... A63B 69/40

[52] U.S. Cl. ..... 124/16; 124/32; 124/36

[58] Field of Search ..... 124/16, 17, 32, 124/36, 54

[56] References Cited

U.S. PATENT DOCUMENTS

| | | | |
|---|---|---|---|
| 2,650,585 | 9/1953 | Farre, Jr. | 124/7 |
| 3,470,859 | 10/1969 | Ponza | 124/36 X |
| 3,659,576 | 5/1972 | Eade et al. | 124/7 |
| 3,754,544 | 8/1973 | Glaser | 124/7 |
| 3,777,733 | 12/1973 | Mitchell | 124/7 |
| 4,015,578 | 4/1977 | Wright | 124/7 |
| 4,168,695 | 9/1979 | Haller et al. | 124/16 |
| 4,262,648 | 4/1981 | Wegener et al. | 124/32 X |
| 4,368,885 | 1/1983 | Katada et al. | 273/29 A |
| 4,391,264 | 7/1983 | Abraham et al. | 124/50 |
| 5,396,876 | 3/1995 | Liscio et al. | 124/6 |
| 5,676,120 | 10/1997 | Joseph | 124/6 |

*Primary Examiner*—John A. Ricci
*Attorney, Agent, or Firm*—Flanagan & Flanagan; John K. Flanagan; John R. Flanagan

[57] ABSTRACT

A ball throwing apparatus includes a ball feeding guide, an actuator with a movable stop member, a throwing arm and ball launching guide. The ball feeding guide defines a path open at and extending between first and second ends for receiving balls at the first end, guiding the balls in a single file arrangement along the path with the balls being movable by the force of gravity through the path and feeding the balls from the second end. The actuator is disposed adjacent to the second end of the ball feeding guide and its stop member is movable between an extended position in which the stop member blocks the path and thereby retains the balls in the single file arrangement within the path and a retracted position in which the stop member unblocks the path and thereby allows the feeding of balls from the path at the second end of the ball feeding guide. The actuator is operable to move the stop member from the extended position to the retracted position and back to the extended position in a manner allowing for feeding of one ball at a time from the ball feeding guide. The throwing arm has a first end for receiving the one ball at a time fed from the second end of the ball feeding guide and is pivotally movable about an axis at a second end between a ball receiving position in which the first end of the throwing arm is located to receive the one ball at a time from the second end of the ball feeding guide and a ball launching position in which the throwing arm upon movement relative to the ball launching guide from the ball receiving position to the ball launching position is adapted to release and throw the ball away from the apparatus.

18 Claims, 5 Drawing Sheets

FIG. 4
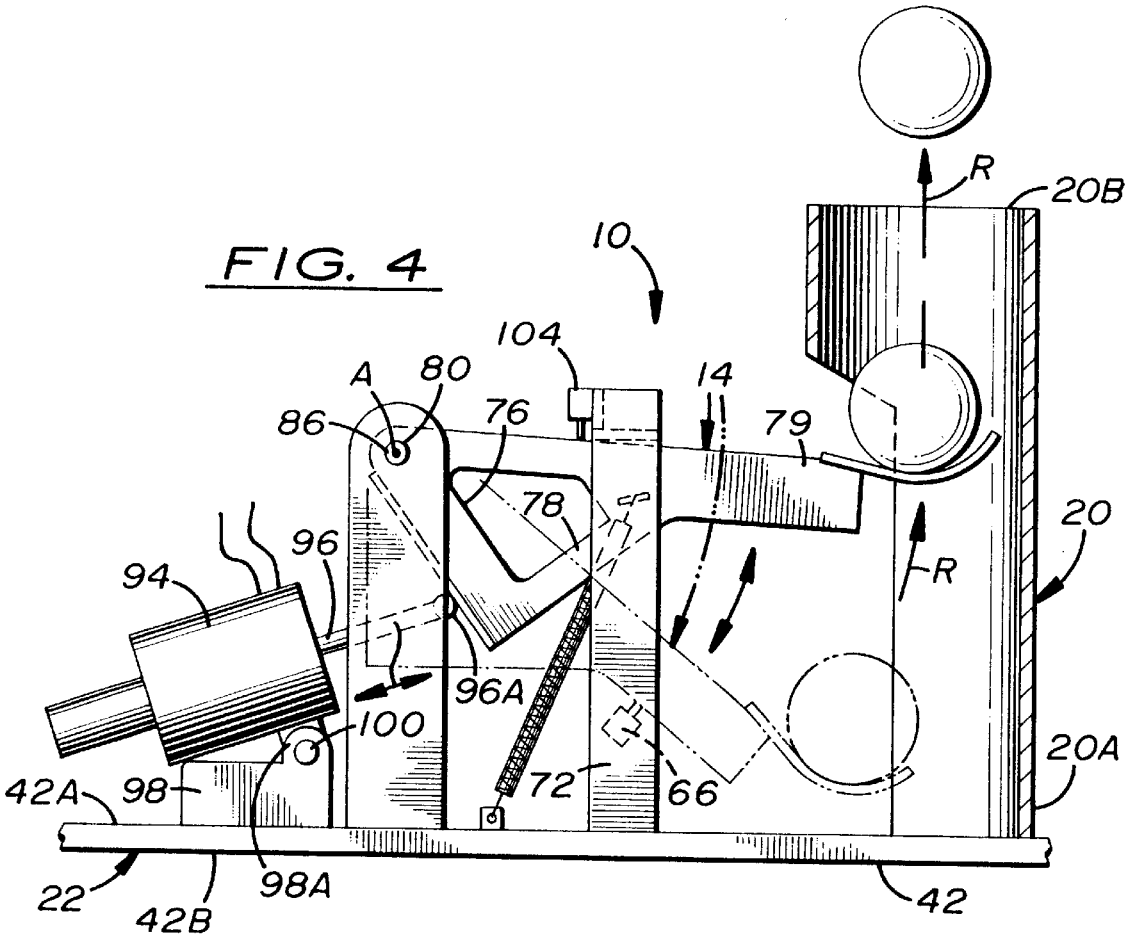
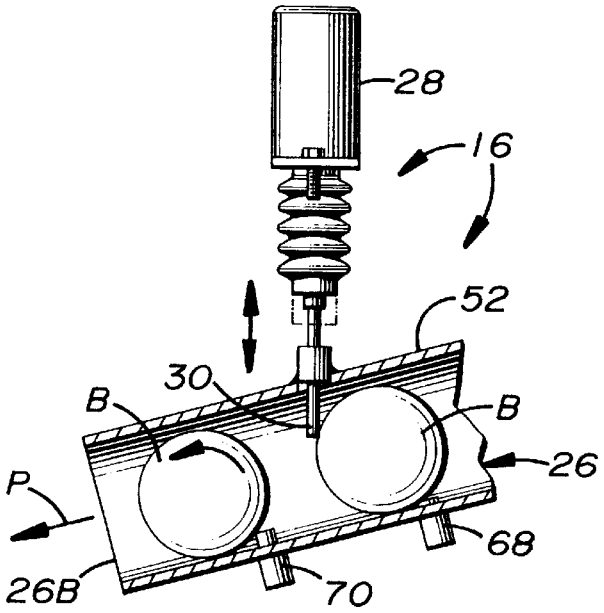
FIG. 5

BALL THROWING APPARATUS

BACKGROUND OF THE INVENTION

1. Field of the Invention

The present invention generally relates to devices for throwing balls and, more particularly, is concerned with a ball throwing apparatus.

2. Description of the Prior Art

Baseball and softball players often practice hitting and catching balls. It is generally necessary to have at least two people to practice, one to throw or hit balls and one to hit or catch balls. Sometimes, however, one person may desire to practice hitting and catching when a second person is not available. Various devices have been developed over the years which enable individuals to practice hitting and catching by themselves. These prior art devices typically are designed to throw a ball which an individual can either hit or catch.

Representative examples of prior art ball throwing devices and the like are disclosed in U.S. Pat. No. 2,650,585 to Farre, Jr., U.S. Pat. No. 3,659,576 to Eade et al., U.S. Pat. No. 3,754,544 to Glaser, U.S. Pat. No. 3,777,733 to Mitchell, U.S. Pat. No. 4,015,578 to Wright, U.S. Pat. No. 4,168,695 to Haller et al., U.S. Pat. No. 4,368,885 to Katada et al., U.S. Pat. No. 4,391,264 to Abraham et al., U.S. Pat. No. 5,396,876 to Liscio et al. and U.S. Pat. No. 5,676,120 to Joseph. While the devices of the prior art patents appear to be satisfactory in use for the specific purposes for which they were designed, none of the devices seem to provide a solution which is versatile, inexpensive, lightweight, safe and portable.

Consequently, a need still exists for an apparatus which provides an optimum solution to the aforementioned problems in the prior art without introducing any new problems.

SUMMARY OF THE INVENTION

The present invention provides a ball throwing apparatus designed to satisfy the aforementioned need. The ball throwing apparatus of the present invention may be used to practice hitting and catching balls of any suitable type. Balls are thrown by the apparatus to different heights and distances for improving eye-hand coordination. The ball throwing apparatus is more versatile, less expensive, lighter, safer and more portable than prior art devices.

Accordingly, the present invention is directed to a ball throwing apparatus which comprises: (a) a ball feeding guide having opposite first and second ends and defining a path open at and extending between the first and second ends for receiving balls at the first end, guiding the balls in a single file arrangement along the path with the balls being movable by the force of gravity through the path and feeding the balls from the second end; (b) an actuator disposed adjacent to the ball feeding guide near the second end thereof and having a stop member movable between an extended position in which the stop member blocks the path of the ball feeding guide adjacent to the second end thereof and thereby retains the balls in the single file arrangement within the path of the ball feeding guide spaced from the second end thereof and a retracted position in which the stop member unblocks the path of the ball feeding guide and thereby allows the feeding of balls from the path of the ball feeding guide at the second end thereof, the actuator being operable so as to move the stop member from the extended position to the retracted position and back to the extended position in a manner allowing for feeding of one ball at a time from the ball feeding guide; (c) first means for controlling movement of the stop member of the actuator between the extended and retracted positions; (d) a throwing arm having opposite first and second ends, the first end for receiving the one ball at a time fed from the second end of the ball feeding guide, the throwing arm being pivotally movable about an axis at the second end thereof between a ball receiving position in which the first end of the throwing arm is located to receive the one ball at a time from the second end of the ball feeding guide and a ball launching position in which the throwing arm upon movement from the ball receiving position to the ball launching position is adapted to release and throw the ball away from the apparatus; and (e) second means for controlling movement of the throwing arm between the ball receiving and launching positions. More particularly, the first means for controlling movement of the stop member of the actuator includes first, second and third sensors. The first sensor is disposed at a location adjacent to the throwing arm and is operable to actuate the actuator so as to cause the stop member thereof to move from the extended position to the retracted position in response to the throwing arm reaching the ball receiving position. The second sensor is disposed along the path of the ball feeding guide adjacent to and on a side of the actuator opposite from the second end of the ball feeding guide and is operable to allow the first sensor to actuate the stop member of the actuator to move from the extended position to the retracted position only when a ball next to be fed past the actuator to the second end of the throwing arm is sensed by the second sensor. The third sensor is disposed along the path of the ball feeding guide between the actuator and the second end of the ball feeding guide and is operable to allow the stop member of the actuator to move from the retracted position to the extended position in response to the third sensor sensing a ball moving therepast along the path of the ball feeding guide from the actuator to second end of the throwing arm.

The present invention also is directed to a ball throwing apparatus which comprises: (a) means for feeding balls one at a time to a predetermined position; (b) a throwing arm having opposite first and second ends and a cup-shaped holder disposed at the first end for receiving one ball at a time thereon, the throwing arm being pivotally movable about an axis at the second end thereof between a ball receiving position and a ball launching position, the cup-shaped holder of the throwing arm in the ball receiving position being disposed at the predetermined position to which balls are fed by the ball feeding means, the throwing arm upon movement from the ball receiving position to the ball launching position being adapted to release and throw the ball from the cupshaped holder away from the apparatus; (c) a ball launching guide defining a path having a portion shaped to receive and partially confine the cup-shaped holder of the throwing arm and the ball disposed on the cup-shaped holder as the throwing arm moves the cup-shaped holder and the ball from the ball receiving position to the ball launching position; and (d) means for controlling movement of the throwing arm between the ball receiving and launching positions. The ball launching guide has a generally semicircular transverse configuration along the portion of the path thereof.

The present invention further is directed to a ball throwing apparatus which comprises: (a) means for feeding balls one at a time to a predetermined position; (b) a throwing arm having opposite first and second ends, the throwing arm at the first end being adapted to receive one ball at a time, the throwing arm being pivotally movable about an axis at the second end between a ball receiving position and a ball launching position, the first end of the throwing arm in the ball receiving position being disposed at the predetermined position to which balls are fed by the ball feeding means, the first end of the throwing arm in the ball launching position being adapted to release and throw the ball from the first end thereof away from the apparatus upon movement of the throwing arm from the ball receiving position to the ball launching position; (c) a driver having a drive rod movable between a retracted position and an extended position, the drive rod of the driver in the retracted position allowing positioning of the throwing arm in the ball receiving position, the drive rod of the driver upon moving to the extended position producing a sufficient driving force to cause the throwing arm to move to the ball launching position and to thereby release and throw the ball from the first end of the throwing arm; and (d) means for controlling movement of the drive rod of the driver between the retracted and extended positions. More particularly, the throwing arm is springbiased to the ball receiving position. The drive rod of the driver contacts the throwing arm at an intermediate position between the first and second ends of the throwing arm. The means for controlling movement of the drive rod of the driver includes first and second switches. The first switch is disposed at a remote location and actuatable to cause the drive rod of the driver to move from the retracted position to the extended position. The second switch is disposed at the location of the throwing arm in the ball launching position and is actuated in response to the throwing arm reaching the ball launching position to cause the drive rod of the driver to move from the extended position to the retracted position. The ball throwing apparatus further comprises means for controlling the velocity of movement of the drive rod of the driver from the retracted position to the extended position for varying the height and distance from the apparatus balls are thrown by the throwing arm. The means for controlling the velocity includes a lever actuatable between different positions corresponding to different desired velocities of the drive rod of the driver and corresponding to different desired heights and distances balls are thrown by the throwing arm.

These and other features and advantages of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the following detailed description, reference will be made to the attached drawings in which:

FIG. 4 is an enlarged side elevational view of a portion of the ball throwing apparatus of FIG. 3 depicting the throwing arm of the apparatus being pivotally moved by a drive rod of a driver of the apparatus from the ball receiving position toward a ball launching position.

FIG. 5 is an enlarged detailed view of an actuator of the ball throwing apparatus disposed adjacent to the ball feeding guide of the apparatus with a stop member of the actuator in an extended position blocking a path of the ball feeding guide.

DETAILED DESCRIPTION OF THE INVENTION

Figure 1:
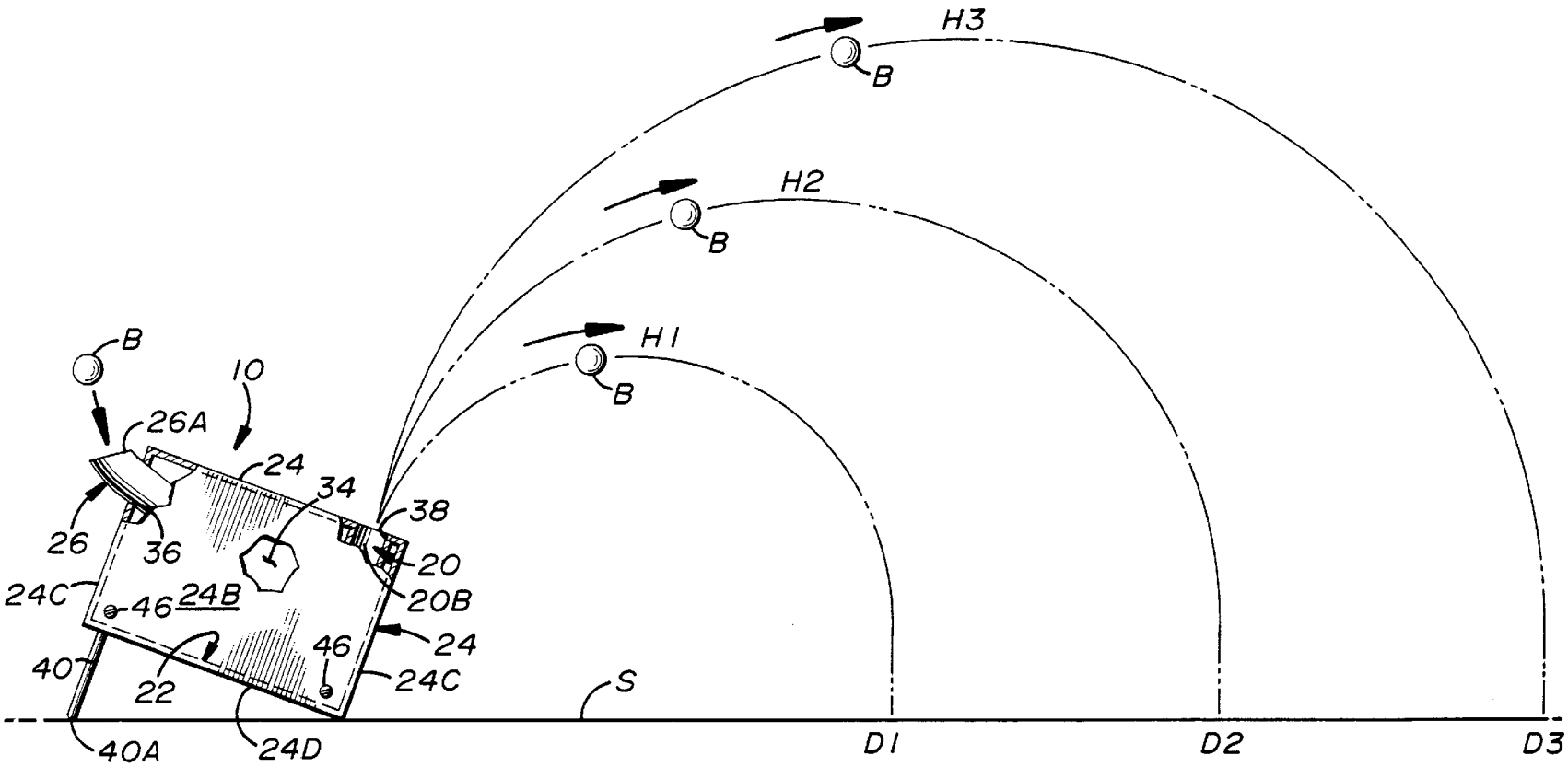
FIG. 1 is a side elevational view of a ball throwing apparatus of the present invention showing a ball to be placed into a ball feeding guide of the apparatus and showing three different heights and distances through which balls may be thrown by the apparatus.

Referring to the drawings and particularly to FIGS. 1 to 4, there is illustrated a ball throwing apparatus, generally designated 10, of the present invention. The ball throwing apparatus 10 basically includes a ball feeding means 12, a throwing arm 14, and first and second control mechanisms 16, 18 for respectively controlling operation of the ball feeding means 12 and the throwing arm 14. Additionally, the apparatus 10 includes a ball launching guide 20, a support frame 22 and an enclosure 24.

Figure 2:
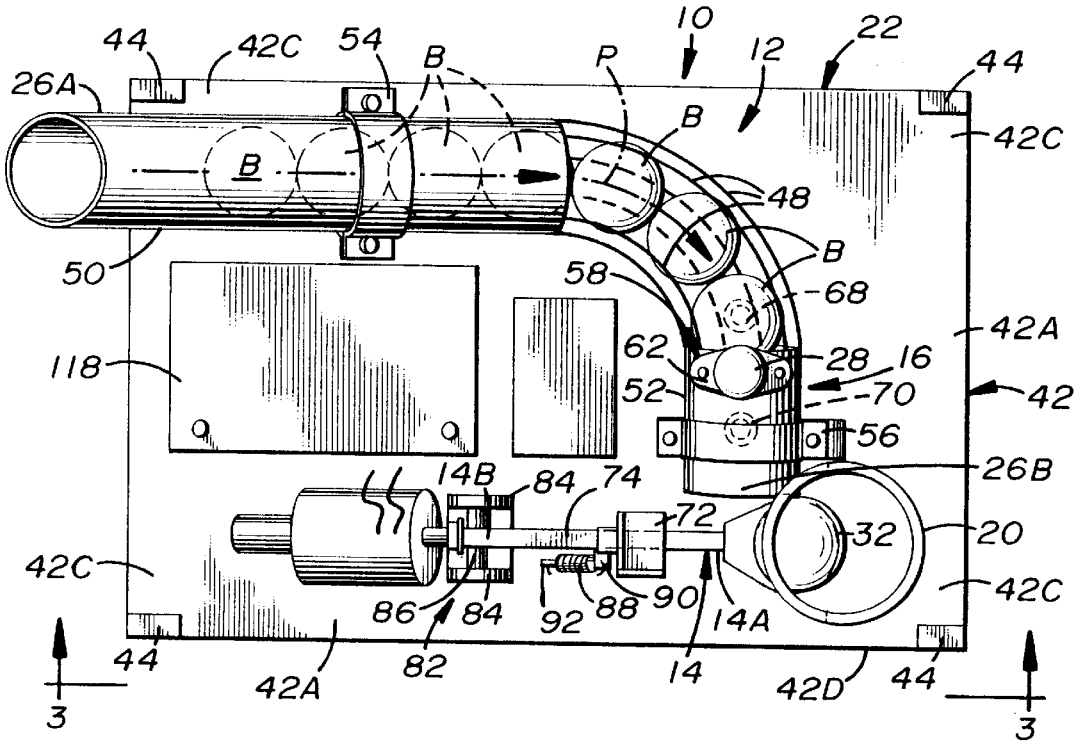
FIG. 2 is an enlarged top plan view of the ball throwing apparatus with an enclosure of the apparatus removed.

More particularly, the ball feeding means 12 includes a ball feeding guide 26 and an actuator 28 with a movable stop member 30. The ball feeding guide 26 of the apparatus 10 defines a path P open at and extending between first and second ends 26A, 26B of the ball feeding guide 26 and declining from the first end 26A to the second end 26B thereof for receiving balls B at the first end 26A, guiding the balls B in a single file arrangement, as seen in FIG. 2, along the path P with the balls B being movable by the force of gravity through the declining path P and feeding the balls B from the second end 26B. The actuator 28 of the apparatus 10 is disposed adjacent to the second end 26B of the ball feeding guide 26 and its stop member 30 is movable between an extended position, as seen in solid line form in FIG. 5, in which the stop member 30 blocks the path P and thereby retains the balls B in the single file arrangement within the path P and a retracted position, as seen in dashed line form in FIG. 5, in which the stop member 30 unblocks the path P and thereby allows the feeding of balls B from the path P at the second end 26B of the ball feeding guide 26. The actuator 28 is operable to move the stop member 30 from the extended position to the retracted position and back to the extended position in a manner allowing for feeding of one ball B at a time from the ball feeding guide 26. The first control mechanism 16 controls movement of the stop member 30 of the actuator 28 between the extended and retracted positions.

The throwing arm 14 of the apparatus 10 has a cup-shaped holder 32 mounted on a first end 14A thereof for receiving the one ball B at a time thereon fed from the second end 26B of the ball feeding guide 26. The throwing arm 14 is pivotally movable about a transverse pivot axis A at a second end 14B of the throwing arm 14 between a ball receiving position, as seen in solid line form in FIG. 3 and dashed line form in FIG. 4, in which the first end 14A of the throwing arm 14 is located to receive the one ball B at a time from the second end 26B of the ball feeding guide 26 and a ball launching position, as seen in solid line form in FIG. 4, in which the throwing arm 14 upon movement from the ball receiving position to the ball launching position is adapted to release and throw the ball B away from the apparatus 10. The second control mechanism 18 controls movement of the throwing arm 14 between the ball receiving position and ball launching positions.

The support frame 22 of the apparatus 10 supports the throwing arm 14, first control mechanism 16, ball feeding guide 26, actuator 28, second control mechanism 18, ball launching guide 20 and enclosure 24. The enclosure 24 overlies the support frame 22 and defines thereabove an interior chamber 34. The enclosure 24 has an inlet or first opening 36 and an outlet or second opening 38 which are spaced apart and communicate with the interior chamber 34. Each of the throwing arm 14, ball feeding guide 26, actuator 28, first control mechanism 16, second control mechanism 18 and ball launching guide 20 are disposed within the interior chamber 34 of the enclosure 24. The ball feeding guide 26 extends through the first opening 36 of the enclosure 24 such that the first end 26A of the ball feeding guide 26 is disposed adjacent to and externally of the enclosure 24 for accepting balls B into the ball feeding guide 26. The ball launching guide 20 of the apparatus 10 has opposite receiving and discharge ends 20A, 20B. The receiving end 20A of the ball launching guide 20 is located remote from the second opening 38 of the enclosure 24 and adjacent to the first end 14A of the throwing arm 14 when the throwing arm 14 is at the ball receiving position. The discharge end 20B of the ball launching guide 20 is located adjacent to the second opening 38 of the enclosure 24 and to the first end 14A of the throwing arm 14 when the throwing arm 14 is at the ball launching position to allow for discharge of balls B from the enclosure 24 through the second opening 38 thereof upon movement of the throwing arm 14 relative to the ball launching guide 20 from the ball receiving position to the ball launching position of the throwing arm 14. The support frame 22 also has adjustable means in the form of one or more adjustable legs 40 slidably mounted thereto in any suitable manner for placing and supporting the apparatus 10 in a substantially tilted position relative to an external support surface S, as seen in FIG. 1.

More particularly, in an exemplary embodiment the support frame 22 of the apparatus 10 includes a base member 42 and a plurality of corner tabs 44. The base member 42 is flat and substantially rectangular in configuration. The base member 42 has a top surface 42A, a bottom surface 42B, four corners 42C and a periphery 42D. The corner tabs 44, preferably, are four in number. Each corner tab 44 is rigidly attached on the top surface 42A at one of the corners 42C of the base member 42 and extends a short distance along and vertically upward from the periphery 42D of the base member 42. Each corner tab 44 has a substantially rectangular block-like configuration and has a central hole 44A formed therethrough. The throwing arm 14, first control mechanism 16, ball feeding guide 26, actuator 28, second control mechanism 18 and ball launching guide 20 are supported upon the top surface 42A of the base member 42 of the support frame 22.

The enclosure 24 has a substantially rectangular box-like configuration but does not have a bottom wall. The enclosure has a top wall 24A, a pair of opposite side walls 24B, a pair of opposite end walls 24C and a lower peripheral edge 24D. When the enclosure 24 is mounted over and to the support frame 24, the lower peripheral edge 24D of the enclosure 24 is disposed adjacent to and about the periphery 42D of the base member 42 of the support frame 24. The side walls 24B of the enclosure 24 are disposed outwardly of and extend alongside the corner tabs 44 on the base member 42 such as the enclosure 24 can be detachably attached to the base member 24 by passing screw fasteners 46 through the holes in the side walls 24B of the enclosure 24 and threading the screw fasteners 46 into the central holes 44A of the corner tabs 44 of the support frame 22. The first opening 36 in the enclosure 24 is formed through one of the end walls 24C, adjacent to one of the side walls 24B and to the top wall 24A of the enclosure 24. The second opening 38 in the enclosure 24 is formed through the top wall 24A adjacent to the other of the side walls 24B and the other of the end walls 24C. Both first and second openings 36, 38 have a substantially circular configuration, though need not be so limited. The adjustable legs 40 which are used to support the apparatus 10 in the substantially tilted position, as shown in FIG. 1, are mounted to and extend outwardly from the bottom surface 42B of the base member 42 adjacent to the one end wall 24C of the enclosure 24 having the first opening 36 therein. The adjustable legs 40 at their lower ends 40A and the base member 22 and enclosure 24 at their respective periphery 42D and lower peripheral edge 24D adjacent to the other end wall 24C of the enclosure 24 rest on the external support surface S, such as the ground or a floor.

Referring now to FIGS. 1 to 5, in an exemplary embodiment the ball feeding guide 26 is comprised of a plurality of longitudinal rails 48 and a pair of sleeves 50, 52, although any portion or all of the ball feeding guide 26 may include the rails and/or sleeves. Each of the sleeves 50, 52 has a substantially circular cross-sectional configuration and the rails 48 are laterally spaced apart from one another and extend between the sleeves 50, 52. The rails 48 and sleeves 50, 52 define the declining feed path P of the balls B and provide the ball feeding guide 26 with a generally J-shaped longitudinal configuration when viewed from above, as shown in FIG. 2. The sleeve 50 of the ball feeding guide 36 is curved upwardly adjacent to the first end 26A thereof such that the first end 26A substantially faces upwardly for making it easier for a user to drop balls B into the ball feeding guide 26 at the first end 26A thereof. The ball feeding guide 26 has a diameter which is substantially uniform along a length thereof and slightly greater than a diameter of each ball B such that the balls B may fit snugly therethrough and yet roll from the first end 26A toward the second end 26B of the ball feeding guide 26 along the declining path P due to the force of gravity.

Figure 3:
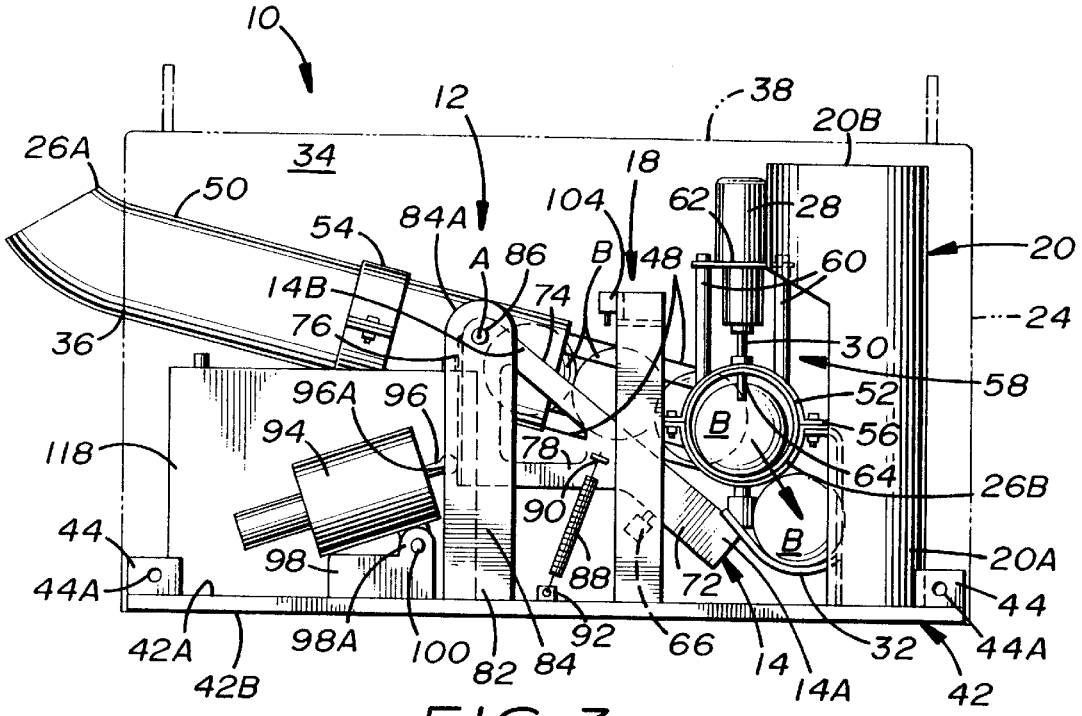
FIG. 3 is a side elevational view of the ball throwing apparatus as seen along line 3—3 of FIG. 2 depicting a throwing arm of the apparatus in a ball receiving position.

As seen in FIGS. 2 and 3, the ball feeding means 12 also includes a pair of ball feeding guide support members 54, 56 which clamp about the sleeves 50, 52 of the ball feeding guide 26 and are fixed upon and extend upwardly from the top surface 42A of the base member 42 of the support frame 22. One support member 54 clamps the one sleeve 50 at a location spaced from but disposed closer to the first end 36A than to the second end 26B of the ball feeding guide 26 while the other support member 56 clamps the other sleeve 52 at a location disposed adjacent to the second end 26B of the ball feeding guide 26.

In an exemplary embodiment, the actuator 28 of the apparatus 10 is a conventional type of electromechanical solenoid actuator having a reciprocable plunger forming the stop member 30. The actuator 28 is mounted upon the sleeve 52 of the ball feeding guide 26 by an actuator support member 58 disposed adjacent to the other support member 56 on a side thereof opposite from the second end 26B of the ball feeding guide 26. The actuator support member 58 includes a pair of legs 60 spaced apart from one another and extending upright from the sleeve 52 and a collar 62 mounted to and extending between upper ends 60A of the leg members 60. The collar 62 is disposed in a transverse relation to the legs 60 and attached around the actuator 28. As mentioned earlier, the stop member 30 of the actuator 28 is linearly movable between the extended and retracted positions shown in FIG. 5. The stop member 30 is rod-like and spring-biased to the extended position shown in solid line form in FIG. 5. The ball feeding guide 26 has a hole 64 below the actuator 28 through which the stop member 30 extends.

As shown in FIGS. 2 to 6, the first control mechanism 16 for controlling linear movement of the stop member 30 of the actuator 28 between the extended and retracted positions includes first, second and third sensors 66, 68, 70. The sensors 66, 68, 70 are conventional microswitches although any other suitable types of sensors may be used. The first sensor 66 is mounted on a post 72 supported upright on the base member 42 of the support frame 22. The post 72 disposes the first sensor 66 at a location adjacent to the throwing arm 14. The first sensor 66 is operable to actuate the actuator 28 so as to cause the stop member 30 thereof to move from the extended position, as shown in solid line form in FIG. 5, to the retracted position, as shown in dashed line form in FIG. 5, in response to the throwing arm 14 reaching the ball receiving position, as shown in solid line form in FIG. 3 and dashed line form in FIG. 4, where it contacts the first sensor 66. The second sensor 68 is mounted to the underside of the sleeve 52 of the ball feeding guide 26 wherein it is disposed along and extends into the path P of the ball feeding guide 26 adjacent to and on a side of the actuator 28 opposite from the second end 26B of the ball feeding guide 26. At such location, the second sensor 68 is operable to allow the first sensor 66 to actuate the stop member 30 of the actuator 28 to move from the extended to retracted position only when a ball next to be fed past the actuator 28 to the second end 26B of ball feeding guide 26 contacts and thus is sensed by the second sensor 68. The third sensor 70 also is mounted to the underside of the sleeve 52 of the ball feeding guide 26 wherein it is disposed along and extends into the path P of the ball feeding guide 26 between the actuator 28 and the second end 26B of the ball feeding guide 26. At such location, the third sensor 70 is operable to allow the stop member 30 of the actuator 28 to move from the retracted to extended position in response a ball B moving past the third sensor 70 along the path of the ball feeding guide 26 from the actuator 28 to the second end 26B of the ball feeding guide 26 contacting and thus being sensed by the third sensor 70.

Referring now to FIGS. 2 to 4, in an exemplary embodiment the throwing arm 14 of the apparatus 10 has a substantially flat configuration. The throwing arm 14 has a first arm member 74, a second arm member 76 and a reinforcing link member 78. The first arm member 74 has opposite first and second ends 74A, 74B with the first end 74A of the first arm member 74 being disposed at the first end 14A of the throwing arm 14. The cup-shaped holder 32 of the throwing arm 14 is rigidly attached on and extending outwardly from the first end 74A of the first arm member 74. The second arm member 76 has opposite first and second ends 76A, 76B. The first and second arm members 74, 76 are rigidly joined together at their second ends 74B, 76B which are disposed at the second end 14B of the throwing arm 14. The first and second arm members 74, 76 are disposed at an acute angle in relation to one another. The link member 78 has opposite first and second ends 78A, 78B. The second arm member 76 and the link member 78 are rigidly joined together at their first ends 76A, 78A and are disposed at a substantially right angle in relation to one another. The link member 78 is rigidly joined at its second end 78B to the first arm member 74 at an intermediate position therealong approximately halfway between the first and second ends 74A, 74B of the first arm member 74. The link member 78 and the first arm member 74 are disposed at an acute angle, such as about forty-five degrees, in relation to one another. The second arm member 76 and link member 78 have similar lengths whereas the first arm member 74 has a length which is approximately twice the length of each of the second arm member 76 and the link member 78. The throwing arm 14 contacts the first sensor or switch 66 at an intermediate position on the first arm member 74 between the point where the link member 78 is joined with the first arm member 74 and the first end 74A of the first arm member 74. The throwing arm 14 has a hole 80 defined at the juncture of its first and second arm members 74, 76.

The support frame 22 also includes an upright structure 82 pivotally mounting the throwing arm 14 at the second end 14B thereof and being comprised of a pair of leg members 84 and a pivot pin 86. The leg members 84 have substantially flat elongated configurations and are spaced apart from one another and disposed in substantially parallel relation to one another on opposite sides of the throwing arm 14. The leg members 84 are rigidly mounted to the top surface 42A of the base member 42 of the support member 22 and extend upright therefrom. The pivot pin 86 has a substantially cylindrical configuration and is disposed and extends between the upper ends 84A of leg members 84. The support structure 82 is spaced from and disposed on a side of the support post 72 opposite from the second end 26B of the ball feeding guide 26. The throwing arm 14 is pivotally mounted at the juncture of the first and second arm members 74, 76 of the throwing arm 14 by the pivot pin 86 which extends through the hole 80 of the throwing arm 14.

The throwing arm 14 is spring-biased to pivotally move to the ball receiving position shown in FIG. 3 by the arrangement and coupling of an elongated coil-type spring 88 between the support frame 22 and the throwing arm 14. The throwing arm 14 has a first tab 90 mounted at the juncture of its first arm member 74 and link member 78. The support frame 22 also has a second tab 92 mounted to the top surface 42A of the base member 42 of the support frame 22. The second tab 92 is disposed between the support post 72 and the throwing arm support structure 82. One end of the spring 88 is secured to the first tab 90 while the other end of the spring 88 is secured to the second tab 92. The spring 88 is in a stretched condition such that it biases the throwing arm 14 to the ball receiving position where the throwing arm 14 will contact the first sensor 66.

The cup-shaped holder 32 of the throwing arm 14 has a substantially round configuration when viewed from above, as shown in FIG. 2 and a substantially dish-like configuration when view from a side thereof, as shown in FIGS. 3 and 4. The cup-shaped holder 32 is mounted at one end to the first end 74A of the first arm member 74 of the throwing arm 14. The cup-shaped holder 32 receives the leading ball B one at a time exiting from the second end 26B of the ball feeding guide 26 when the throwing arm 14 is in the ball receiving position in contact with the first sensor 66.

Referring to FIGS. 2 to 4 and 6, the second control mechanism 18 includes a driver 94 in the form a conventional type of electromechanical solenoid actuator having a plunger providing a drive rod 96 movable between a retracted position and an extended position, as shown respectively in FIGS. 3 and 4. The drive rod 96 is spring-biased to the retracted position. The drive rod 96 of the driver 94 in the retracted position allows positioning of the throwing arm 14 in the ball receiving position, whereas the drive rod 96 of the driver 94 upon moving to the extended position produces a sufficient driving force to cause the throwing arm 14 to move to the ball launching position and to thereby release and throw the ball B from the cup-shaped holder 32 on the first end 14A of the throwing arm 14. The free end 96A of the drive rod 96 contacts the throwing arm 14 at an intermediate position between its first and second ends 14A, 14B and, particularly, at the second arm member 76 closer to the first end 76A than to the second end 76B thereof. The drive 94 hereby operates by a push-action of the drive rod 96 thereof against the throwing arm 14.

Also, the throwing arm driver 94 is mounted above the top surface 42A of the base member 42 of the support frame 22 by a support member 98 having a block-like configuration, as seen in FIGS. 3 and 4. The support member 98 has a tab 98A extending from a top thereof to which the driver 94 is pivotally mounted at 100. The driver 94 is disposed at an acute angle in relation to its support member 98 and the latter is disposed adjacent to the support structure 82 for the throwing arm 14.

Referring to FIGS. 2 to 4, the ball launching guide 20 of the apparatus 10 is mounted upright on and extending upwardly from the top surface 42A of the base member 42 of the support member 22 adjacent to the first end 14A of the throwing arm 14 and the ball receiving position thereof. The ball launching guide 20 defines a launching path R of the ball B and has a lower portion 20A shaped to receive and partially confine the cup-shaped holder 32 on the first end 14A of the throwing arm 14 and the ball B disposed on the cup-shaped holder 32 as the throwing arm 14 moves the cup-shaped holder 32 and ball B from the ball receiving position, as shown in dashed line form in FIG. 4 to the ball launching position, as shown in solid line form in FIG. 4. The lower portion 20A of the ball launching guide 20 preferably has a substantially semicircular transverse configuration therealong.

The second control mechanism 18 of the apparatus 10 includes first and second switches 102, 104. The first switch 102 is disposed at a remote location and actuatable to cause the drive rod 96 of the driver 94 to move from its retracted position to the extended position. The first switch 102 may be an actuatable portion of a foot pedal or a remote control device. The second switch 104 is mounted to the upper end of the support post 72 on the support frame 22 at a location of the throwing arm 14 when in the ball launching position. When the throwing arm 14 engages the second switch 104 upon reaching the ball launching position, the second switch 104 then causes the drive rod 96 of the driver 94 to move from the extended to retracted position. The throwing arm 14 contacts the second switch 104 at an intermediate position on the first arm member 74 thereof adjacent to where the link member 78 is joined with the first arm member 74.

The apparatus 10 also includes means for controlling the velocity or rate at which the drive rod 96 of the driver 94 moves from the retracted to extended position and thus the magnitude of the driving force applied to the throwing arm 14 for varying the height and distance balls B are thrown by the throwing arm 14. The velocity controlling means includes a lever 106 mounted to the support frame 22 and extending through the enclosure 24. The lever 106 is movable between and can be set at selected ones of multiple positions corresponding to different velocities of the drive rod 96 and thereby different heights and different distances H1 & D1, H2 & D2, H3 & D3, as shown in FIG. 1, to which balls B will be thrown by the throwing arm 16. The different positions of the switch 106 may be three in number, though it need not be so limited, corresponding to three different heights and different distances, as shown in FIG. 1.

Figure 6:
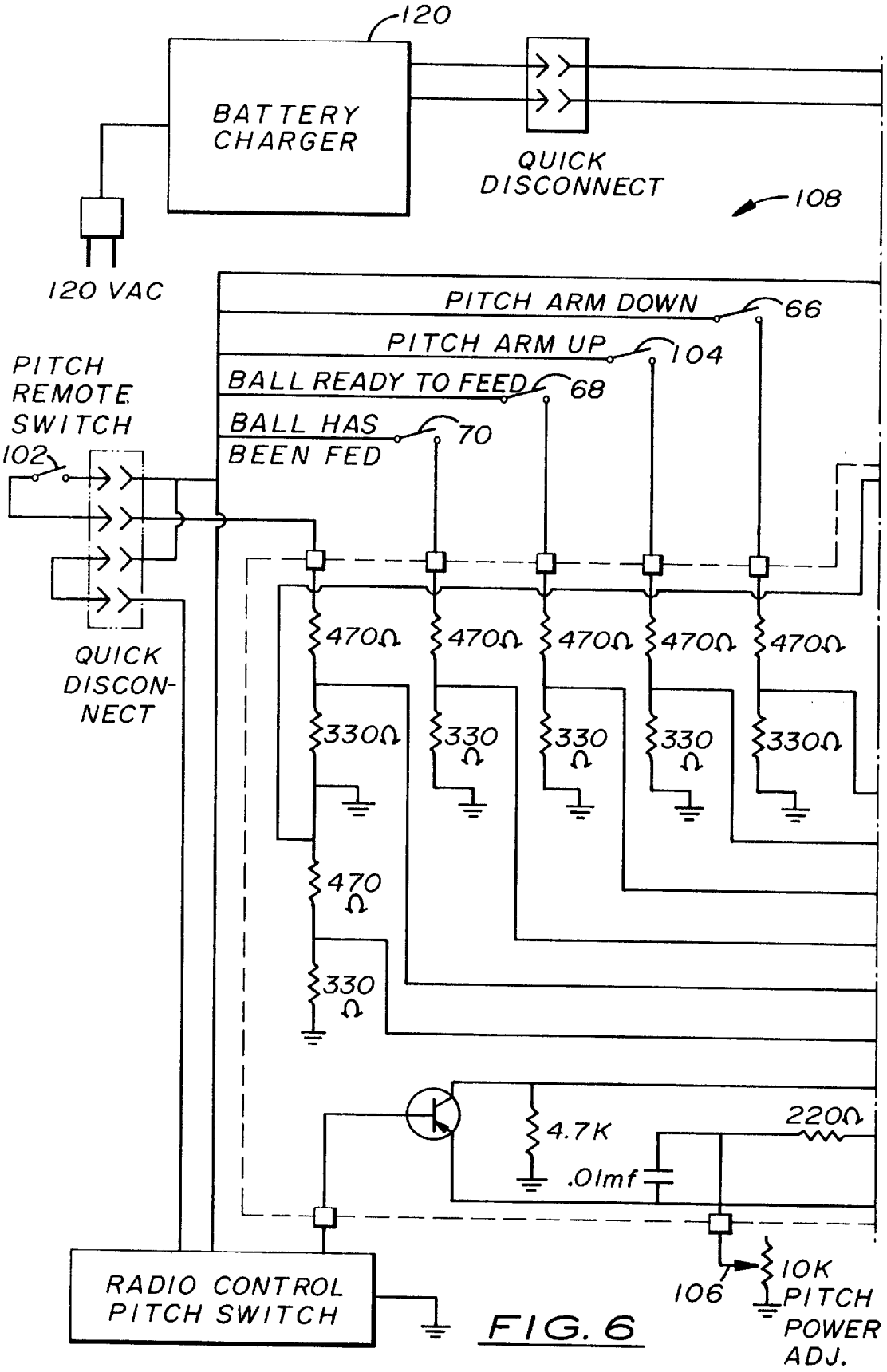
FIG. 6 is a schematic diagram of an electrical circuit of the ball throwing apparatus for controlling the operation of the apparatus.
Figure 6:
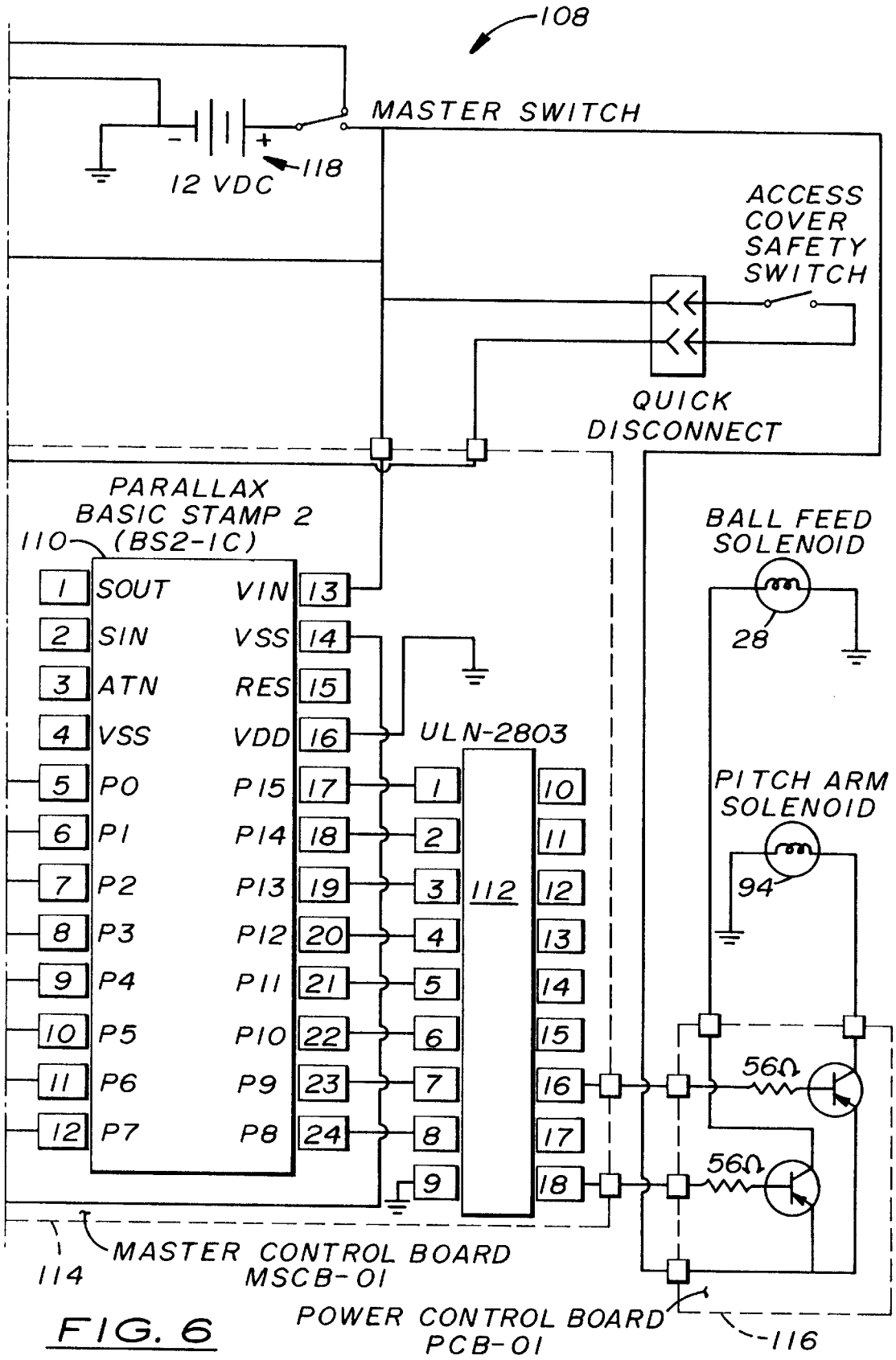

Referring now to FIG. 6, there is shown an electrical circuit, generally designated 108, of the ball throwing apparatus 10 for controlling the operation of the actuator 28 and driver 94 thereof in response to the above-described initiation or activations of the first, second and third sensors 66, 68, 70, the first, second switches 102, 104 and the lever 106. The apparatus 10 also includes an electronics control module 104 having a microprocessor. The electrical circuit 108 also includes integrated logic circuit modules 110, 112 and other transistor drivers and resistors mounted on a master control board 114 and power control board 116 which respond to the high or low states of the sensors and switches to produce output signals that operate the actuator 28 and driver 94 in the above-described desired manner. The master control board 114 and power control board 116 are mounted on the top surface 42A of the base member 42 of the support member 22. The apparatus 10 also includes means in the form of a battery 118 for powering the components on the master control board 114 and power control board 116. The battery 118, preferably is a rechargeable battery, though need not be so limited, with a battery charger 120 connected thereto and to a source of AC current. The battery 118 also is mounted to the top surface 42A of the base member 42 of the support member 22.

It is thought that the present invention and its advantages will be understood from the foregoing description and it will be apparent that various changes may be made thereto without departing from the spirit and scope of the invention or sacrificing all of its material advantages, the form hereinbefore described being merely preferred or exemplary embodiment thereof.

We claim:

1. A ball throwing apparatus, comprising:

(a) a ball feeding guide having opposite first and second ends and defining a path open at and extending between said first and second ends for receiving balls at said first end of said ball feeding guide, guiding the balls in a single file arrangement along said path with the balls being movable by the force of gravity through said path and feeding the balls from said second end of said ball feeding guide;

(b) an actuator disposed adjacent to said ball feeding guide near said second end thereof and having a stop member movable between an extended position in which said stop member blocks said path of said ball feeding guide adjacent to said second end thereof and thereby retains the balls in the single file arrangement within said path of said ball feeding guide spaced from said second end thereof and a retracted position in which said stop member unblocks said path of said ball feeding guide and thereby allows the feeding of balls from said path of said ball feeding guide at said second end thereof, said actuator being operable so as to move said stop member from said extended position to said retracted position and back to said extended position in a manner allowing for feeding of one ball at a time from said ball feeding guide;

(c) first means for controlling movement of said stop member of said actuator between said extended and retracted positions;

(d) a throwing arm having opposite first and second ends, said first end for receiving the one ball at a time fed from said second end of the ball feeding guide, said throwing arm being pivotally movable about an axis at said second end thereof between a ball receiving position in which said first end of said throwing arm is located to receive the one ball at a time from said second end of said ball feeding guide and a ball launching position in which said throwing arm upon movement from said ball receiving position to said ball launching position is adapted to release and throw the ball away from said apparatus; and (e) second means for controlling movement of said throwing arm between said ball receiving and launching positions;

(f) said first means for controlling movement of said stop member of said actuator including (i) a first sensor disposed at a location adjacent to said throwing arm and being operable to actuate said actuator so as to cause said stop member thereof to move from said extended position to said retracted position in response to said throwing arm reaching said ball receiving position, (ii) a second sensor disposed alone said path of said ball feeding guide adjacent to and on a side of said actuator opposite from said second end of said ball feeding guide and being operable to allow said first sensor to actuate said stop member of said actuator to move from said extended position to said retracted position only when a ball next to be fed past said actuator to said second end of said ball feeding guide is sensed by said second sensor, and (iii) a third sensor disposed along said path of said ball feeding guide between said actuator and said second end of said ball feeding guide and being operable to allow said stop member of said actuator to move from said retracted position to said extended position in response to sensing a ball moving past said third sensor along said path of said ball feeding guide from said actuator to second end of said ball feeding guide.

2. The apparatus of claim 1 further comprising:

a support frame supporting said ball feeding guide, actuator, first controlling means, throwing arm and second controlling means.

3. The apparatus of claim 2 wherein said support frame includes adjustable means for supporting said apparatus in a substantially tilted position relative to an external support surface.

4. The apparatus of claim 2 further comprising:

an enclosure mounted to said support frame and defining an interior chamber and having a first opening and a second opening in communication with said interior chamber, each of said support frame, ball feeding guide, actuator, first controlling means, throwing arm and second controlling means being disposed within said interior chamber of said enclosure, said ball feeding guide extending through said first opening of said enclosure such that said first end of said ball feeding guide is disposed adjacent to and externally of said enclosure for accepting balls into said ball feeding guide, said ball launching position of said throwing arm being disposed adjacent to said second opening of said enclosure to allow for discharge of balls from said enclosure through said second opening thereof upon movement of said throwing arm from said ball receiving position to said ball launching position.

5. The apparatus of claim 1 wherein said throwing arm has a cup-shaped holder disposed at said first end of said throwing arm for receiving one ball at a time thereon.

6. A ball throwing apparatus, comprising:

(a) means for feeding balls one at a time to a predetermined position;

(b) a throwing arm having opposite first and second ends and a cup-shaped holder disposed at said first end for receiving one ball at a time thereon, said throwing arm being pivotally movable about an axis at said second end thereof between a ball receiving position and a ball launching position, said cup-shaped holder of said throwing arm in said ball receiving position being disposed at said predetermined position to which balls are fed by said ball feeding means, said throwing arm upon movement from said ball receiving position to said ball launching position being adapted to release and throw the ball from said cup-shaped holder away from said apparatus;

(c) a ball launching guide defining a path having a portion shaped to receive and partially confine said cup-shaped holder of said throwing arm and the ball disposed on said cup-shaped holder as said throwing arm moves said cup-shaped holder and the ball from said ball receiving position to said ball launching position; and (d) means for controlling movement of said throwing arm between said ball receiving and launching positions.

7. The apparatus of claim 6 further comprising:

a support frame supporting said ball feeding means, throwing arm, ball launching guide and means for controlling movement of said throwing arm.

8. The apparatus of claim 7 wherein said support frame includes adjustable means for supporting said apparatus in a substantially tilted position relative to an external support surface.

9. The apparatus of claim 7 further comprising:

an enclosure mounted to said support frame and defining an interior chamber, a first opening and a second opening, each of said support frame, ball feeding means, throwing arm, ball launching guide and means for controlling movement of said throwing arm being disposed within said interior chamber of said enclosure, said first opening of said enclosure allowing for entry into said enclosure of balls to be fed by said ball feeding means to said predetermined position, said second opening of said enclosure allowing for discharge of balls from said enclosure through said second opening thereof upon movement of said throwing arm from said ball receiving position to said ball launching position.

10. The apparatus of claim 6 wherein said ball launching guide has a substantially semicircular transverse configuration along said portion of said path thereof.

11. A ball throwing apparatus, comprising:

(a) means for feeding balls one at a time to a predetermined position;

(b) a throwing arm having opposite first and second ends, said throwing arm at said first end being adapted to receive one ball at a time, said throwing arm being pivotally movable about an axis at said second end between a ball receiving position and a ball launching position, said first end of said throwing arm in said ball receiving position being disposed at said predetermined position to which balls are fed by said ball feeding means, said first end of said throwing arm in said ball launching position being adapted to release and throw the ball from said first end thereof away from said apparatus upon movement of said throwing arm from said ball receiving position to said ball launching position;

(c) a driver having a drive rod movable between a retracted position and an extended position, said drive rod of said driver in said retracted position allowing positioning of said throwing arm in said ball receiving position, said drive rod of said driver upon moving to said extended position producing a sufficient driving force to cause said throwing arm to move to said ball launching position and to thereby release and throw the ball from said first end of said throwing arm;

(d) means for controlling movement of said drive rod of said driver between said retracted and extended positions; and (e) a support frame supporting said ball feeding means, throwing arm, driver and means for controlling movement of said driver rod of said driver, said support frame including adjustable means for supporting said apparatus in a substantially tilted position relative to an external support surface.

12. The apparatus of claim 11 wherein said throwing arm is spring-biased to said ball receiving position.

13. The apparatus of claim 11 further comprising:

means for controlling the velocity of movement of said drive rod of said driver from said retracted position to said extended position for varying the height and distance from said apparatus balls are thrown by said throwing arm.

14. The apparatus of claim 13 wherein said velocity controlling means includes a lever actuatable between different positions corresponding to different desired velocities of said drive rod of said driver and corresponding to different desired heights and different distances balls are thrown by said throwing arm.

15. A ball throwing apparatus, comprising:

(a) means for feeding balls one at a time to a predetermined position;

(b) a throwing arm having opposite first and second ends, said throwing arm at said first end being adapted to receive one ball at a time, said throwing arm being pivotally movable about an axis at said second end between a ball receiving position and a ball launching position, said first end of said throwing arm in said ball receiving position being disposed at said predetermined position to which balls are fed by said ball feeding means, said first end of said throwing arm in said ball launching position being adapted to release and throw the ball from said first end thereof away from said apparatus upon movement of said throwing arm from said ball receiving position to said ball launching position;

(c) a driver having a drive rod movable between a retracted position and an extended position, said drive rod of said driver in said retracted position allowing positioning of said throwing arm in said ball receiving position said drive rod of said driver upon moving to said extended position producing a sufficient driving force to cause said throwing arm to move to said ball launching position and to thereby release and throw the ball from said first end of said throwing arm;

(d) means for controlling movement of said drive rod of said driver between said retracted and extended positions;

(e) a support frame supporting said ball feeding means, throwing arm, driver and means for controlling movement of said driver rod of said driver; and (f) an enclosure mounted to said support frame and defining an interior chamber and having a first opening and a second opening in communication with said interior chamber, each of said support frame, ball feeding means, throwing arm, driver and means for controlling movement of said drive rod of said driver being disposed within said interior chamber of said enclosure, said first opening of said enclosure allowing for entry into said enclosure of balls to be fed by said ball feeding means to said predetermined position, said second opening of said enclosure allowing for discharge of balls from said enclosure through said second opening thereof upon movement of said throwing arm from said ball receiving position to said ball launching position.

16. The apparatus of claim 15 wherein said support frame includes adjustable means for supporting said apparatus in a substantially tilted position relative to an external support surface.

17. A ball throwing apparatus, comprising:

(a) means for feeding balls one at a time to a predetermined position;

(b) a throwing arm having opposite first and second ends, said throwing arm at said first end being adapted to receive one ball at a time, said throwing arm being pivotally movable about an axis at said second end between a ball receiving position and a ball launching position, said first end of said throwing arm in said ball receiving position being disposed at said predetermined position to which balls are fed by said ball feeding means, said first end of said throwing arm in said ball launching position being adapted to release and throw the ball from said first end thereof away from said apparatus upon movement of said throwing arm from said ball receiving position to said ball launching position;

(c) a driver having a drive rod movable between a retracted position and an extended position, said drive rod of said driver in said retracted position allowing positioning of said throwing arm in said ball receiving position, said drive rod of said driver upon moving to said extended position producing a sufficient driving force to cause said throwing arm to move to said ball launching position and to thereby release and throw the ball from said first end of said throwing arm, wherein said drive rod of said driver contacts said throwing arm at an intermediate position between said first and second ends of said throwing arm; and (d) means for controlling movement of said drive rod of said driver between said retracted and extended positions.

18. A ball throwing apparatus, comprising:

(a) means for feeding balls one at a time to a predetermined position;

(b) a throwing arm having opposite first and second ends, said throwing arm at said first end being adapted to receive one ball at a time, said throwing arm being pivotally movable about an axis at said second end between a ball receiving position and a ball launching position said first end of said throwing arm in said ball receiving position being disposed at said predetermined position to which balls are fed by said ball feeding means, said first end of said throwing arm in said ball launching position being adapted to release and throw the ball from said first end thereof away from said apparatus upon movement of said throwing arm from said ball receiving position to said ball launching position;

(c) a driver having a drive rod movable between a retracted position and an extended position, said drive rod of said driver in said retracted position allowing positioning of said throwing arm in said ball receiving position, said drive rod of said driver upon moving to said extended position producing a sufficient driving force to cause said throwing arm to move to said ball launching position and to thereby release and throw the ball from said first end of said throwing arm; and (d) means for controlling movement of said drive rod of said driver between said retracted and extended positions said means for controlling movement of said drive rod of said driver including (i) a first switch disposed at a remote location and actuatable to cause said drive rod of said driver to move from said retracted position to said extended position, and (ii) a second switch disposed at the location of said throwing arm in said ball launching position, said second switch being actuatable in response to said throwing arm reaching said ball launching position to cause said drive rod of said driver to move from said extended position to said retracted position.

* * * * *